United States Patent [19]

Davis et al.

[11] 4,402,839

[45] * Sep. 6, 1983

[54] METAL WORKING LUBRICANT CONTAINING AN ALKANOLAMINE AND A CYCLOALIPHATIC ACID

[75] Inventors: Robert H. Davis, Pitman; Alfred B. Piotrowski, Woodbury, both of N.J.

[73] Assignee: Mobil Oil Corporation, New York, N.Y.

[ * ] Notice: The portion of the term of this patent subsequent to Mar. 31, 1998, has been disclaimed.

[21] Appl. No.: 262,166

[22] Filed: May 11, 1981

[51] Int. Cl.[3] ..... C10M 1/32

[52] U.S. Cl. ..... 252/34.7; 252/49.3; 252/51.5 A

[58] Field of Search ..... 252/34.7, 49.3, 51.5 A

[56] References Cited

U.S. PATENT DOCUMENTS

| | | | |
|---|---|---|---|
| 2,959,547 | 11/1960 | Brillhart | 252/34.7 X |
| 3,006,849 | 10/1961 | Plemich | 252/34.7 |
| 3,071,545 | 1/1963 | Davis et al. | 252/34.7 |
| 3,374,171 | 3/1968 | Davis | 252/49.3 X |
| 3,897,349 | 7/1975 | Marin et al. | 252/34.7 X |
| 4,259,206 | 3/1981 | Piotrowski et al. | 252/49.3 |

FOREIGN PATENT DOCUMENTS

| | | | |
|---|---|---|---|
| 995708 | 6/1965 | United Kingdom | 252/49.3 |
| 639921 | 2/1979 | U.S.S.R. | 252/49.3 |

*Primary Examiner*—Andrew Metz

*Attorney, Agent, or Firm*—Alexander J. McKillop; Michael G. Gilman; Howard M. Flournoy

[57] ABSTRACT

Water soluble lubricant compositions comprising alkanolamine and organic acid are improved by employing a monocycloalkyl-1,2,3,6-cis tetrahydrophthalate or hexahydrophthalate; or a monoaralkyl-1,2,3,6-cis tetrahydrophthalate or hexahydrophthalate as the organic acid.

11 Claims, No Drawings

METAL WORKING LUBRICANT CONTAINING AN ALKANOLAMINE AND A CYCLOALIPHATIC ACID

BACKGROUND OF THE INVENTION

1. Field of the Invention

This invention relates to lubricant compositions and more particularly to water-soluble lubricant compositions adapted for use as lubricants and coolants in metal machining operations.

2. Description of the Prior Art

In machining operations of metals, such as cutting, grinding, turning, milling and the like, it is customary to flood the tool and the work with a coolant for the purpose of carrying off heat which is produced during the operation. It is also customary to employ these coolants in combination with various agents having lubricating and extreme-pressure properties for reducing friction between the tool and work piece, particularly in operations such as tapping and broaching. In this respect, it has, heretofore, been the practice to employ for such purpose aqueous compositions containing such lubricating agents as emulsified petroleum or non-petroleum additives. Such aqueous cutting fluids, in order to perform satisfactorily, should meet certain important requirements.

Among the requirements for a satisfactory cutting fluid are corrosion-inhibiting properties for ferrous and cuprous alloys, and also stability under the conditions of operation. While various cutting fluids may possess such characteristics, there are, however, further important requirements that should also be met. Among these requirements is the ability to avoid leaving deposits on the tool and the work following the machining operation which result from subsequent drying of the fluid and which are difficult to remove. Other important requirements include tolerance in hard water solutions so that the precipitation of lubricant components will not occur, avoidance of tacky residues which interfere with the operation of the machine and avoidance of excessive foam formation. Cutting fluids known prior to this invention have not, however, satisfactorily met all of the foregoing requirements.

U.S. Pat. No. 3,374,171 teaches lubricants for metal working that contain alkanolamine polyoxyalkylene glycol and a saturated organic acid having 6 to 9 carbon atoms.

SUMMARY OF THE INVENTION

In accordance with the invention, there is provided an improved water-soluble lubricant, said lubricant comprising an alkanolamine and an organic acid, the improvement wherein the organic acid has the formula

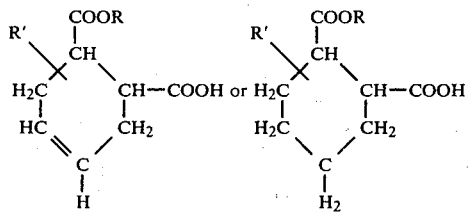

wherein R is a cyclohexyl or benzyl group or substituted members thereof and R' is a lower alkyl group having up to 7 carbon atoms. Preferably, R' is a methyl group.

DESCRIPTION OF SPECIFIC EMBODIMENTS

The advantages of the improved lubricant are realized with aqueous compositions comprising a major proportion of water and, in individual minor proportions, a water-soluble alkanolamine and a water-soluble polyoxyalkylene glycol. In this respect, it is found that the alkanolamine component, in addition to functioning as a corrosion-inhibiting agent in which the aforementioned organic acids are soluble, also functions as a plasticizer in that, in the course of use, evaporation of water from the cutting fluid leaves a residue upon machinery parts which is desirably soft or semi-liquid. The function of the organic acid component in combination with the alkanolamine is primarily that of a corrosion inhibitor in that it forms the corresponding amine acid salt.

The water-soluble alkanolamine employed in the novel formulation may be of any molecular weight but should, preferably, be liquid at room temperature. The lower molecular weight compounds are generally preferred and, for this purpose, it has been found that such alkanolamines as mono-, di- or triethanolamine are most effective. Other water-soluble alkanolamines may also be employed, and include such alkanolamine as isopropanolamines, e.g., mono-, di- and triisopropanolamine, dimethylethanolamine, diethylethanolamine, aminoethylethanolamine, N-acetylethanolamine, phenylethanolamine, phenyldiethanolamine and mixtures thereof.

The organic acid employed is an alkyl substituted tetrahydro- or hexahydrophthalic acid-ester of the formula

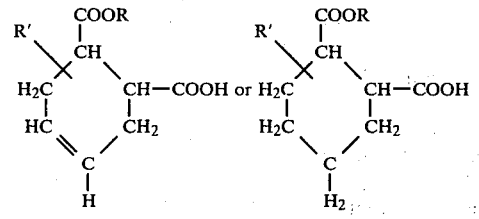

wherein R is a cyclohexyl or benzyl group and R' is a lower alkyl group having up to 6 carbon atoms.

The lubricant will normally contain a load support agent. Included among such agents are the polyoxyalkylene glycols. The preferred members include water-soluble oils obtained by copolymerizing mixtures of ethylene oxide and propylene oxide, e.g., oils prepared by copolymerizing a 50—50 mixture of ethylene oxide and propylene oxide; water-soluble heteric copolymeric alkylene glycols, ethers or esters thereof, wherein the different oxyalkylene units are substantially randomly distributed throughout the entire polyoxyalkylene chain; water-soluble polyoxyalkylene compounds containing hydrophobic homopolyoxyalkylene units; and polymeric agents in general, which are block copolymers of cogeneric mixtures of conjugated polyoxyalkylene compounds containing at least one hydrophobic homopolyoxyalkylene unit, having a unit weight of at least about 800, and one or two other hydrophilic polymeric units which comprise from about 15 percent to about 90 percent of the total polymeric compound. The most desirable watersoluble polyoxyalkylene glycols for use in the formulations of the present invention comprise the polyether polyols produced by reacting ethylene oxide and propylene oxide having hydroxyl numbers from about 22 to about 38. If so desired, in order to impart increased anti-rust properties to the aqueous lubricant composition, an alkali metal nitrite may also be employed in the novel formulation. In this respect, it is found that more specific increased resistance to copper corrosion may also be obtained by the additional use of the sodium salt of mercaptobenzothiazole, benzotriazole or tolutriazole.

The aforementioned novel formulations of water-soluble alkanolamine, organic acid and water-soluble polyoxyalkylene glycol may also include a wide variable of germicidal agents for inhibiting bacterial growth. For this purpose, the germicidal agent may comprise, for example, a halogenated cresol, either completely or partially halogenated cresol, and may include such representative compounds as completely or partially chlorinated, brominated, fluorinated or iodated cresols. Typical examples of this class of materials include: chloro-, dichloro-, trichloro- and tetrachlorocresols; bromo-, dibromo-, tribromo, and tetrabromocresols, or any of the aforementioned components in which the chlorine or bromine atoms are substituted in whole or in part by fluorine or iodine. More specific compounds include: para-chloro-meta-cresol; para-bromo-meta-cresol; para-fluoro-meta-cresol; 2,4-dibromo-meta-cresol; 2,4,5trichloro-meta-creesol; 2,4,5,6-tetrachloro-meta-cresol; 2,4dibromo-meta-cresol; 2,4,5-tribromo-meta-cresol; 2,4,5,6tetrabromo-meta-cresol; or any of the aforementioned compounds in which the chlorine or bromine atoms are substituted in whole or in part by fluorine or iodine; or any corresponding ortho or paracresols of the aforementioned compounds substituted for the corresponding meta-cresols.

Other germicidal agents that may be employed in the above-described novel formulations may include aldehydes, such as formaldehyde, or aldehyde-releasing agents such as formaldehyde-releasing agents, i.e, materials which break down in storge to form the aldehyde or aldehyde compounds as decomposition products. Thus, it is found that compounds such as tris(hydroxymethyl) nitromethane are particularly effective in releasing formaldehyde and thereby providing germicidal protection over relatively long periods of time. Other microbicidal gases that may be employed for this purpose include ethylene oxide and beta propiolactone. Alcohols such as methyl alcohol, ethyl alcohol or higher alcohols may also be employed as germicidal agents. Other effective germicidal agents include halogens and halogen compounds, particularly iodine and chlorine and compounds of these halogens. Specific compounds of this type may include chlorine of lime and iodophors. Furthermore, as germicidal agents, compounds of heavy metals may include such compounds as bichloride of mercury and organic mecurials such as Mercurochrome, Merthiolate, Metaphen, silver nitrate and copper sulfate. Germicidal agents comprising phenol and its derivatives may also be employed in the novel formulations, which include the aforementioned cresols and bis-phenols. Synthetic detergents may also be employed as germicidal agents, which are of the non-phenolic type. These may include, for example, ammonium halides, such as ammonium chloride, in which the hydrogen atoms have been replaced by organic radicals; particularly effective are quaternary compounds in which the long-chain organic radical (alkyl group) contains from 12 to 16 carbon atoms. Other materials include quaternary compounds in which the organic group is an anion, e.g., sodium laurylsulfate, as well as those compounds which do not ionize.

The novel lubricant compositions of the present invention, as previously indicated, are formulated in accordance with certain balanced proportions expressed in weight percent. The alkanolamine is employed in an amount from about 5 to about 50 percent, and preferably in an amount from about 20 to about 40 percent, by weight. The organic acid component is employed in an amount from about 1 to about 30 percent, and preferably in an amount from about 10 to about 25 percent, by weight. The polyoxyalkylene glycol is employed in an amount from about 0.5 to about 20 percent, and preferably in an amount from about 0.5 to about 3 percent, by weight. Where a germicidal agent is also to be incorporated in the novel formulation, these agents are employed in an amount from about 0.05 to about 5 percent, and preferably in an amount from about 0.5 to about 3 percent, by weight. When the alkali metal nitrite is to be included in the formulation, it is generally employed in an amount from about 0.1 to about 10 percent, and preferably in an amount from about 0.1 to about 5 percent, by weight. When benzotriazole is to be included in the formulation, it is generaly present in an amount from about 0.1 to about 5 percent, and preferably from about 0.1 to about 2 percent, by weight. If so desired, other additives for enhancing rust protection or for the purpose of changing the pH of the system may be employed. Such additional additives may include boric acid, borate esters or oxides of boron for enhancing rust protection, and are generally employed in an amount from about 0.1 to about 5 percent, and preferably from about 0.1 to about 3 percent, by weight. For raising the pH of the system, such additional additives may be employed in the form of alkali metal hydroxides, including more specifically, sodium, lithium or potassium hydroxide. When the latter are present, they are generally employed in an amount from about 0.1 to about 3 percent, and preferably from about 0.1 to about 1.5 percent, by weight. Furthermore, if so desired, various water-soluble chelating agents may be employed to soften the water vehicle. These may include, for example, salts of ethylenediamine tetraacetic acid, nitrilotriacetic acid or diethylene triamine pentaacetic acid. When any of the aforementioned chelating agents are employed, they are generally present in an amount from about 0.1 to about 5 percent, by weight. In each instance, of course, it will be apparent that sufficient water is employed in order to balance the formulation.

The novel lubricant compositions of the present invention are preferably prepared by a blending procedure which comprises mixing the alkanolamine and organic acid components with about 10 to about 20 parts of water, which is to be present in the finished formulation. This blending procedure may be carried out at room temperature. However, heating to 120° F. with agitation is most satisfactory. The remaining quantity of water required to be present in the finished product is added, together with the polyoxyalkylene glycol, and any of the aforementioned other desired components. It should be noted, however, that if an alkali metal nitrite is to be present in the finished product, such material is added last for the reason that addition of acids such as caprylic acid to a solution of sodium nitrite could result in decomposition of the nitrite, thus reducing or nullifying its rust-inhibiting effects. If a germicidal agent is to be incorporated in the novel formulation, it is preferably blended with the alkanolamine and organic acid.

The compounding of the novel compositions of the present invention may be illustrated by the preparation of lubricant and cutting fluids from the formulations in the following table and examples and which also include comparative data. They were tested in a corrosion test, as follows:

Corrosion Test

One to three grams of malleable iron chips are placed on a filter paper in a glass petri dish, 10 grams of test fluid which is to be evaluated is placed on the chips and allowed to stand at a temperature of about 70° F. for a period of about 24 hours. After this period the sample is then checked for the appearance of rust. In the data presented in the following table, R designates rusting of the sample iron chips while N.R. signifies no rust.

EXAMPLE 1

Mono-Cyclohexyl Ester of Methyl-cis-1,2,3,6-Tetrahydrophthalic Acid

Eighty-three grams (0.5 mole) of methyl-cis-1,2,3,6-tetrahydrophthalic anhydride and 51.0 g (0.5 mole) of cyclohexanol were heated gradually to 135° C. and held at that temperature for 3.4 hours.

EXAMPLE 2

Mono-Benzyl Ester of Methyl-cis-1,2,3,6-Tetrahydrophthalic Acid

Eighty-three grams (0.5 mole) of methyl-cis-1,2,3,6-tetrahydrophthalic anhydride and 54.2 g (0.5 mole) of benzyl alcohol were heated gradually to 135° C. and held at that temperature for 3–4 hours.

EXAMPLE 3

Mono-Cyclohexyl Ester of Methyl Hexahydrophthalic Acid

Eighty-four grams (0.5 mole) of undistilled or distilled methyl hexahydrophthalic anhydride and 51.0 g (0.5 mole) of cyclohexanol were heated gradually to 135° C. and held at that temperature for 3–4 hours.

EXAMPLE 4

Mono-Benzyl Ester of Methyl Hexahydrophthalic Acid

Eighty-four grams (0.5 mole) of undistilled or distilled methyl hexahydrophthalic anhydride and 54.2 g (0.5 mole) of benzyl alcohol were heated gradually to 135° C. and held at that temperature for 3–4 hours.

TABLE 1

Lubricant Composition

| Example | DEA[1] Wt. % | TEA[2] Wt. % | Phthalic Anhydride Wt. % | Monocyclohexyl Phthalate, Wt. % | Monobenzyl Phthalate, Wt. % | Cis-1,2,3,6-Tetrahydro-Phthalic Anhydride Wt. % |
|---|---|---|---|---|---|---|
| A | 18.5 | 20.5 | 22.0 | — | — | — |
| B | 18.5 | 20.5 | — | 22.0 | — | — |
| C | 18.5 | 20.5 | — | — | 22.0 | — |
| D | 18.5 | 20.5 | — | — | — | 22.0 |
| 1 | 18.5 | 20.5 | — | — | — | — |
| 2 | 18.5 | 20.5 | — | — | — | — |
| 3 | 18.5 | 20.5 | — | — | — | — |
| 4 | 18.5 | 20.5 | — | — | — | — |

| Example | Example 1 | Example 2 | Example 3 | Example 4 | Glycol,* Wt. % | Water, Wt. % | Malleable Iron Rust Test - Dilutions in Distilled Water** 60:1 | 90:1 | 120:1 |
|---|---|---|---|---|---|---|---|---|---|
| A | — | — | — | — | 15.0 | 20.25 | R | R | R |
| B | — | — | — | — | 15.0 | 20.25 | R | R | R |
| C | — | — | — | — | 15.0 | 20.25 | R | R | R |
| D | — | — | — | — | 15.0 | 20.25 | R | R | R |
| 1 | 22.0 | — | — | — | 15.0 | 20.25 | NR | NR | R |
| 2 | — | 22.0 | — | — | 15.0 | 20.25 | NR | NR | R |
| 3 | — | — | 22.0 | — | 15.0 | 20.25 | NR | NR | NR |
| 4 | — | — | — | 22.0 | 15.0 | 20.25 | NR | NR | R |

[1]Diethanolamine.
[2]Triethanolamine.
Each Example contained 1.9 wt. % of an ethylene oxide-propylene oxide copolymer having a molecular weight of 2180, 0.25 wt. % of benzotriazole, 1.5 wt. % of a triazine type aldehyde releaser and 0.1% of an odorant.
*Diethylene glycol.
**Parts of composition to parts of distilled water.

We claim:

1. An improved water-soluble composition suitable for preparing an aqueous lubricant, said composition comprising an alkanolamine said alkanolamine comprising from about 5% up to about 50% by weight, and an organic acid, said organic acid comprising from about 1% up to about 30% by weight, the improvement wherein the organic acid has the formula

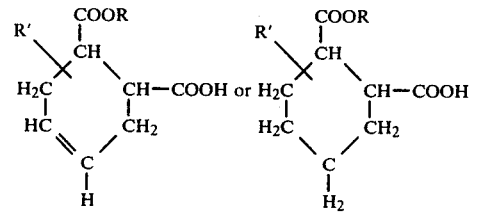

wherein R is a cyclohexyl or benzyl group or substituted members thereof and R' is a lower alkyl group having up to 6 carbon atoms.

2. The composition of claim 1 wherein R′ is methyl.

3. The composition of claim 1 wherein R is cyclohexyl.

4. The composition of claim 1 wherein R is benzyl.

5. The composition of claim 1 which additionally comprises a polyoxyalkylene glycol.

6. The composition of claim 5 wherein the glycol is a copolymer of ethylene and propylene oxides.

7. The composition of claim 1 wherein the alkanolamine is diethanolamine.

8. The composition of claim 1 wherein the alkanolamine is triethanolamine.

9. The composition of claim 1 containing from about 5 to about 50 percent by weight of said alkanolamine.

10. The composition of claim 1 containing from about 1 to about 30 percent by weight of said organic acid.

11. The composition of claim 5 wherein said polyoxyalkylene glycol comprises from about 0.5 to about 20 percent by weight thereof.

* * * * *